United States Patent [19]

Durfee

[11] 4,239,482

[45] Dec. 16, 1980

[54] FUEL BURNER WITH AIR-DEFLECTING OBJECT AND METHOD THEREFOR

[76] Inventor: Edward P. Durfee, 12 Granite St., Milford, N.H. 03055

[21] Appl. No.: 895,702

[22] Filed: Apr. 12, 1978

[51] Int. Cl.[3] ..... F23D 13/40

[52] U.S. Cl. ..... 431/354; 431/350

[58] Field of Search ..... 431/265, 347, 350, 354; 239/590; 60/39.72 R

[56] References Cited

U.S. PATENT DOCUMENTS

| | | | |
|---|---|---|---|
| 2,632,300 | 3/1953 | Brzozowski | 431/347 |
| 2,899,799 | 8/1959 | Setterblade | 60/39.72 R |
| 3,051,464 | 8/1962 | Yeo et al. | 431/351 |
| 3,270,506 | 9/1966 | Bahr | 60/39.72 R |
| 3,574,507 | 4/1971 | Kydd | 60/39.72 R |
| 3,830,620 | 8/1974 | Martin | 431/350 |
| 3,918,885 | 11/1975 | Palm et al. | 431/265 |

FOREIGN PATENT DOCUMENTS

| | | | |
|---|---|---|---|
| 80682 | 4/1963 | France | 431/265 |

*Primary Examiner*—Carroll B. Dority, Jr.
*Attorney, Agent, or Firm*—Bruce D. Sunstein

[57] ABSTRACT

There is provided an improved fuel burner of the type having an air blower and blast tube. The improvement involves placement of an air-deflecting object inside the housing of the air blower or in the blast tube. In one embodiment, the object has a V-shaped cross section, and is attached to a gently tapered cylinder; the object can be held in place by inserting it through a hole of appropriate dimension in the air blower or blast tube, and tapping on the exposed end of the tapered cylinder until the latter is engaged in the hole. There is also provided a method of improving a fuel burner by mounting a air-deflecting object of the type described in the air blower housing or in the blast tube.

16 Claims, 10 Drawing Figures

FUEL BURNER WITH AIR-DEFLECTING OBJECT AND METHOD THEREFOR

BACKGROUND OF THE INVENTION

The present invention relates to heating devices of the type employing a blower to force air into a combustion chamber, where oxygen in the air reacts chemically with a fuel, such as oil or gas, to cause burning of the fuel. Oil burners used in space heating applications are conventionally of this type. In particular, the present invention relates to an improved design of fuel burner and a method and device for improving the performance of conventional designs of such a fuel burner.

Fuel burners are used, for example, both in furnaces and in boilers. Convection, steam, and other methods are used to accomplish transfer of heat resulting from combustion sustained through operation of these devices. In practice, fuel burners are often designed to cause the air to enter the combustion chamber co-extensively with the fuel to be burned. When the fuel is oil, the oil is generally atomized or vaporized and thereafter caused to mix physically with the air and to flow into the combustion chamber with it. This air-fuel mixture then burns by reacting chemically in the combustion chamber.

Various methods of improving the performance of fuel burners are known in the prior art. Some of these methods, pertinent to the invention described herein, operate by enhancing, in the furnace's combustion chamber, the extent of turbulence in the flow of the air-fuel mixture. Such additional turbulence has been created by the insertion into the combustion chamber of objects having surfaces specially shaped so as to tend to break up any smooth flow of the air-fuel mixture in the combustion chamber. Such additional turbulence has also been created in the prior art by employing an object to modify the flow of the air-fuel mixture at the point where it first enters the combustion chamber.

In U.S. Pat. No. 3,918,885, issued for an invention of B. O. M. Palm et al., there is disclosed an apparatus and method for reducing the dynamic pressure of air that has been blown by the blower at the burner head of an oil-burning appliance. The invention utilizes a series of baffles to form a labyrinthine path for the air to flow between the output of the blower and the burner head. Certain other embodiments are disclosed that involve use of small turbines and slotted members, through which the air is required to pass. Generally, the labyrinthine structure is confined to the blast tube, and requires a plurality of baffles. Where baffles are not used, more complicated structures are employed. These structures are not readily conducive to modification of existing oil burners, and may depend on different physical principles for their successful operation. Nowhere does the patent refer to the use of a single protrusion for improving the performance of fuel burners, and nowhere does the patent disclose the use of an air-deflecting object in the blower housing itself.

SUMMARY OF THE INVENTION

It is a primary object of the present invention to provide an improved design of fuel burners and a method for improving the performance of conventional designs of fuel burners.

It is a further object of this invention to provide increased fuel efficiency in fuel burners.

Another object of this invention is to provide fuel burners utilizing a higher flame temperature and greater heat output, for a given rate of fuel consumption, than provided by conventional fuel burners.

It is a further object of this invention to provide a device for insertion in a conventional fuel burner to improve the performance thereof.

It is a further object of this invention to cause fuel to burn more completely than it would with conventional burners, and thereby also (i) to reduce the tendency of deposits to form in the combustion chambers of heating devices using fuel burners and (ii) to reduce the rate at which heat transfer in such heating devices is impeded by the formation of deposits.

It is also an object of this invention to reduce the amount of environmental pollution caused by the operation of fuel burners in providing a specified amount of heat output.

Furthermore, it is an object of the present invention to achieve the foregoing objects by modifying the nature of the air flow, compared with the air flow existing in a conventional fuel burner, beginning at a point prior to that at which the air enters the combustion chamber.

In accordance with the invention, there is provided a fuel burner of the type having an air blower in a housing that is in communication with a blast tube. In this type of fuel burner, the air blower gives rise to an air flow in the blower housing and thereafter through the blast tube. The improvement in this fuel burner is provided by an object for deflecting a portion of the air flow and a means for mounting the object either in the blower housing or in the blast tube.

In a preferred embodiment of the invention, the object has a generally V-shaped cross section, and is attached to a tapered cylinder. The object is mounted in a hole in the blower housing or in the blast tube; it is inserted through the hole so that the tapered cylinder engages against the perimeter of the hole. In another preferred embodiment of the invention, there is provided a device having an object with a V-shaped cross-section as aforementioned; also as aforementioned the object is attached to a tapered cylinder. The device can be used as previously described, and in accordance with a preferred embodiment of the method, to improve the performance of a fuel burner.

BRIEF DESCRIPTION OF THE DRAWINGS

These and other objects and features of the invention will be more readily understood from a consideration of the following detailed description taken with the accompanying drawings, in which.

DESCRIPTION OF SPECIFIC EMBODIMENTS

Figure 1:
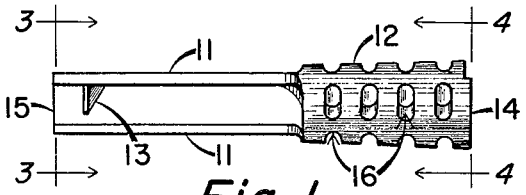
FIG. 1 is a side view of a device constructed in accordance with the invention.
Figure 2:
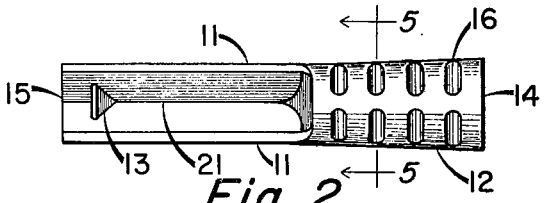
FIG. 2 is another side view of the device, wherein the device has been rotated somewhat about its longitudinal axis.

Referring now to the specific embodiments of the invention shown in the drawings by way of example only, FIG. 1 and FIG. 2 show two side views of a preferred embodiment of a device constructed in accordance with the present invention. In FIG. 2 the device is somewhat rotated about its longitudinal axis in comparison to FIG. 1. The device includes two prolongated spans 11 that lie in different planes. These spans have a common edge 21. The spans form the "object" end 15 of the device. In practice, the prolongated spans need not be wholly flat, and, furthermore, the non-common edges of the spans may be serrated. They are reinforced at this end of the device by strut 13, which is triangular shaped and runs between the spans.

Still in reference to FIGS. 1 and 2, it can be seen that these spans are attached to a tapered cylinder 12. The cylinder is covered with recesses 16, which occur in groups around the circumference of the cylinder. The right-hand end of the cylinder 14 is designated as the "head" of the device.

Figure 3:
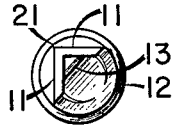
FIG. 3 is an end view of the device of FIG. 1 as seen through the plane 3—3.

In FIG. 3, which is an end view through plane 3—3 of FIG. 1, it can be seen that the prolongated spans 11 intersect to form a V-shaped cross-section. Also apparent is the strut 13 running between the spans. The spans intersect at the vertex 21 of the V-shape, which is also the common edge 21 of the spans shown in FIG. 2. The slight taper of the cylinder 12 makes it just visible in this figure.

Figure 4:
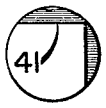
FIG. 4 is an end view of the device of FIG. 2 as seen through the plane 4—4.

FIG. 4 is a view through plane 4—4 of FIG. 1. Thus the head 14 of FIG. 1 is shown in direct view in FIG. 4. The head is fitted with an arrow 41.

Figure 5:
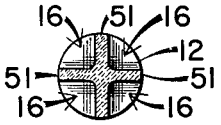
FIG. 5 is a cross-section of the device of FIG. 2 taken through the plane 5—5.

FIG. 5 is a cross-sectional view of the device shown in FIG. 2 taken through the plane of 5—5. This plane has been chosen to show the appearance of the device in cross-section at a point where there appears a group of four recesses 16. The recesses are formed so that there remains a plus-shaped structure 51 in this portion of the cylinder so as to insure its strength even in the presence of the recesses.

Figure 6:
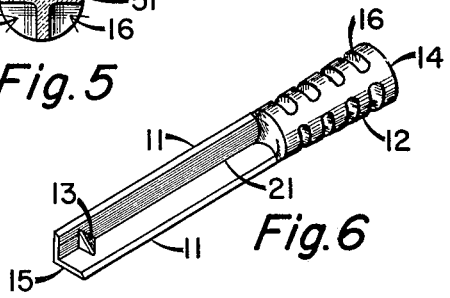
FIG. 6 is a perspective view of the device shown in FIG. 1.

FIG. 6 is a perspective view of the device of FIG. 1. Shown are the head 14 and object end 15, the prolongated spans 11, their common edge 21, and reinforcing strut 13. Also shown are the tapered cylinder 12 and the recesses 16.

Figure 7:
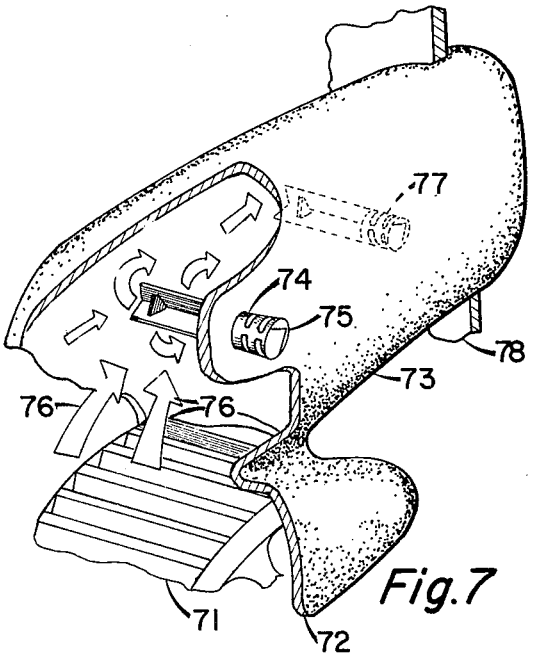
FIG. 7 shows a portion of an oil burner constructed in accordance with the invention.

In FIG. 7 is shown a portion of a fuel burner utilizing the invention. The invention is applicable to a fuel burner of the type having a blower, shown in part here as item 71, located in a housing 72, which is in communication with a blast tube 73. The blast tube interfaces with the wall 78 of a combustion chamber. In order to construct a fuel burner in accordance with the invention, and in order to improve a fuel burner in accordance with the invention, the object is placed in the air flow path of the fuel burner. In this preferred embodiment, a hole is formed in the wall of the lower housing 72, and there is inserted into the hole the device of FIGS. 1 through 6. The orientation of the device is important, although some beneficial effects have been observed regardless of its orientation. Preferably, however, the device is oriented so that air initially flows into the crotch of the V-shape formed by the intersection of the two prolongated spans. The air flow is indicated by arrows 76. To assist in determining the proper orientation of the device, it is provided with the arrow 75. In a preferred embodiment of the device this arrow points generally in the direction of the vertex of the intersection of the planes in which lie the prolongated spans. Thus the device is properly oriented when the arrow 75 points in the direction of the air flow, which can be determined by observation of the blower. Preferably, the device 74 is placed at a point in the blower housing just prior to where the air leaves such housing and enters into the blast tube. In some instances, however, there is insufficient clearance between the outer portion of the blower 71 and the housing 72 to permit mounting of the device 74 in its preferred location. Under these circumstances, the device can be mounted in the blast tube. Such a location for the device is shown by the dashed outline of the device as item 77.

Figure 8:
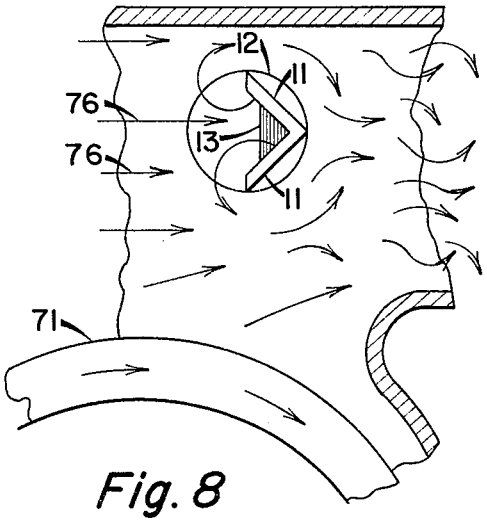
FIG. 8 shows in detail the operation of the invention in an oil burner, and in particular presents a cross-sectional view of air flow in the vicinity of a device placed in an oil burner in accordance with the invention.

FIG. 8 shows in further detail the operation of the device in a schematized cross-section. The blower 71 causes air, represented by arrows 76, to move through the lower housing and blast tube. Air in the vicinity of the device is deflected. Shown in cross-section are the prolongated spans 11, the reinforcing strut 13, and the tapered cylinder 12. It is believed that the presence of the prolongated spans causes a peculiarly efficacious turbulence to appear in the wake of the device. This turbulence is indicated by the curved arrows. In tests, installation of a device in accordance with the invention has been found to increase the temperature of the gases in the flu stack by approximately 130 degrees Farenheit in ordinary household furnaces, corresponding approximately to an increase of 390 degrees Farenheit in combustion chamber temperature. Simultaneously there was determined to be a decrease in percentage of smoke, indicating that more complete combustion occurs when my invention is employed than when it is not.

Figure 9:
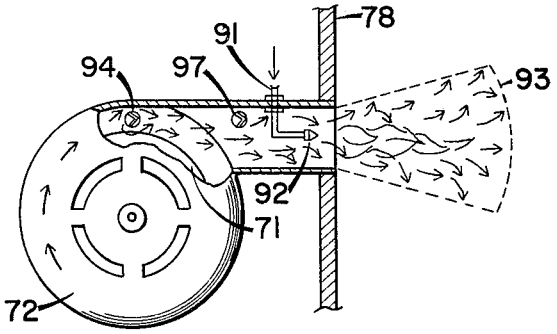
FIG. 9 shows more generally the placement of the device in accordance with the invention in an oil burner.

FIG. 9 shows a more complete view of the portion of the oil burner shown in FIG. 7. Location of the device 74 in FIG. 7 corresponds to the location of the device 94 in FIG. 9 in the blower housing 72. Similarly the alternative location shown for the device 77 in FIG. 7 corresponds to the alternative location for the device 97 shown in FIG. 9. Also shown in FIG. 9 are the oil inlet pipe 91 and the nozzle 92 through which the oil emerges into the output of the blast tube. The oil-gas mixture emerges from the blast tube to the combustion chamber, a wall 78 of which is shown. On the emergence from the blast tube the ignited mixture forms a flame cone 93. Also shown are the blower, 71 and the blown air (as arrows) emerging from the blower.

Figure 10:
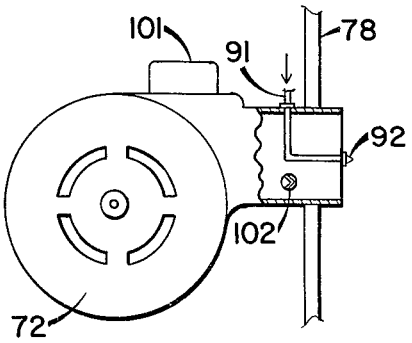
FIG. 10 shows use of the device with another design of oil burner.

FIG. 10 shows another design of fuel burner. In this design of fuel burner a transformer 101 is placed at the top of the position where the blower housing is joined to the blast tube. Placement of the device in the usually preferred location cannot be effected with this particular design, since there is an undue risk that the device may run afoul of wiring to the transformer or that other complications may ensue. Moreover, the presence of the fuel line 91 also can interfere with placement of the device. Accordingly the device, shown as 102 in the figure, can be placed as shown. Also shown in the figure are combustion chamber wall 78, nozzle 92, and blower housing 72, which items correspond to those described in reference to FIG. 9.

Preferably, the device is able to withstand the relatively high temperatures present in the vicinity of the combustion chamber. Moreover, the device should be sufficiently rigid to withstand the pressures of air flow against the prolongated spans, also to withstand the tapping of the device into the hole that has been formed for it. These qualities may suggest that the device can be usefully constructed of a suitable metallic substance. While such substance may work, I have found that some resiliance in the material can be useful, inter alia, to assist in keeping the tapered cylinder thereof snuggly nested in the hole that has been drilled for it. Accordingly, I have found that choice of a suitable plastic such as polyphenylene sulfide, is an excellent material for this purpose, combining high melting point, durability, and some resiliance.

Although the invention has been shown and described with particular reference to specific embodiments thereof in the interest of complete definiteness, it will be understood that it may be embodied in a variety of forms, diverse from those specifically shown and described, without departing from the spirit and scope of the invention as defined by the following claims.

What is claimed is:

1. An improved fuel burner of the type having an air blower in a housing that is in communication with a blast tube (such housing and blast tube being collectively called the "air passageway"), such air blower giving rise to an air flow in the air passageway, wherein the improvement comprises:

an object, for deflecting a portion of the air flow, such object being sufficiently small so that it is capable of being mounted in the air passageway without causing an undesirable extent of interference with operation of the fuel burner, wherein such object as mounted includes a single protrusion from the inside surface of the air passageway, such protrusion having two prolongated spans lying in different planes and joined along a common edge so as to form a rod of generally V-shaped cross-section; and means for mounting the object in the air passageway, such means including a gently tapered cylinder, having a larger end and a smaller end, the smaller end of which is rigidly attached to one end of the object (such object and tapered cylinder in combination being called the "device", having an "object end" at the non-attached end of the object and a "head" at the non-attached larger end of the tapered cylinder) so that the object can be mounted by insertion of the device, object end first, into a suitably formed hole in the air passageway and thereafter by engagement of the tapered cylinder, against the air passageway walls that form the hole, by tapping on the head of the device.

2. The apparatus of claim 1, wherein the object further comprises at least one triangular strut, placed in a plane at right angles to the planes of both prolongated spans forming the rod, and joined to one of the spans at each of the two edges of the strut.

3. The apparatus of claim 2, wherein there are formed in the tapered cylinder a plurality of recesses.

4. The apparatus of claim 3, wherein the recesses are formed and grouped so as to give the tapered cylinder a plus-shaped cross-section at each group of recesses.

5. The apparatus of claim 1, further comprising, on the head of the device, a mark to indicate the orientation of the device in the air passageway.

6. The apparatus of claim 5, wherein the mark is an arrow, lying in a plane that bisects the angle formed by the surfaces of the prolongated spans, and the tip of which points generally to the vertex of such angle.

7. The apparatus of claim 1, wherein the device is made of polyphenylene sulfide.

8. A device for deflecting a portion of the air flow in a fuel burner, of the type having an air blower in a housing that is in communication with a blast tube (such housing and blast tube being collectively called the "air passageway"), such device being capable of being mounted in a suitably formed hole in the air passageway and comprising:

an object including two prolongated spans lying in different planes and joined along a common edge so as to form a rod of generally V-shaped cross-section; and a mounting head including a gently tapered a cylinder having a larger end and a smaller end, the smaller end of which is rigidly attached to one end of the object.

9. The device of claim 8, wherein the object further comprises at least one triangular strut, placed in a plane at right angles to the planes of both prolongated spans forming the rod, and joined to one of the spans at each of the two edges of the strut.

10. The device of claim 9, wherein there are formed in the tapered cylinder a plurality of recesses.

11. The device of claim 10, wherein the recesses are formed and grouped so as to give the tapered cylinder a plus-shaped cross-section at each group of recesses.

12. The device of claim 8, further comprising, on the head of the device, a mark to indicate the orientation of the device in the air passageway.

13. The device of claim 12, wherein the mark is an arrow, lying in a plane that bisects the angle formed by the surfaces of the prolongated spans, and the tip of which points a generally to the vertex of such angle.

14. The device of claim 8, wherein the device is made of polyphenylene sulfide.

15. A method of improving the performance of a fuel burner of the type having an air blower in a housing that is in communication with a blast tube (such housing and blast tube being collectively called the "air passageway"), such air blower giving rise to an air flow in the air passageway, wherein the method comprises:

(a) drilling an appropriate sized hole into the air passageway; and (b) mounting in the air passageway a device, for deflecting a portion of the air flow, such device comprising (i) an object including two prolongated spans lying in different planes and joined along a common edge so as to form a rod of generally V-shaped cross-section; and (ii) a mounting head including a gently tapered cylinder having a larger end and a smaller end, the smaller end of which is rigidly attached to one end of the object; this step of mounting the device including (x) inserting the device, object end first, into the hole; and (y) tapping on the larger end of the mounting head of the device so as to engage the tapered cylinder against the air passageway walls that form the hole.

16. The method of claim 15, further comprising, between steps (x) and (y), the steps of (i) determining the direction of air flow in the passageway in the vicinity of the hole, and (ii) orienting the device so that air flow is directed into the crotch of the generaly V-shaped cross-section of the prolongated spans, i.e., (i) the direction of air flow is approximately parallel to a plane that bisects the angle formed by the surface of the prolongated spans and (ii) the portion of the spans at the vertex of such angle is downstream of the remaining portions of the spans.

* * * * *